US012516664B2

(12) United States Patent
Eckert et al.

(10) Patent No.: US 12,516,664 B2
(45) Date of Patent: Jan. 6, 2026

(54) METHOD FOR OPERATING A PUMP

(71) Applicant: Robert Bosch GmbH, Stuttgart (DE)

(72) Inventors: Michael Eckert, Achern (DE); Volker Hofacker, Ottersweier (DE)

(73) Assignee: Robert Bosch GmbH, Stuttgart (DE)

( * ) Notice: Subject to any disclaimer, the term of this patent is extended or adjusted under 35 U.S.C. 154(b) by 418 days.

(21) Appl. No.: 17/784,206

(22) PCT Filed: Dec. 9, 2020

(86) PCT No.: PCT/EP2020/085176
§ 371 (c)(1),
(2) Date: Jun. 10, 2022

(87) PCT Pub. No.: WO2021/116141
PCT Pub. Date: Jun. 17, 2021

(65) Prior Publication Data

US 2023/0036511 A1 Feb. 2, 2023

(30) Foreign Application Priority Data

Dec. 10, 2019 (DE) ..... 10 2019 219 217.3

(51) Int. Cl.
*F04B 49/02* (2006.01)
*F04D 15/02* (2006.01)

(52) U.S. Cl.
CPC ..... *F04B 49/02* (2013.01); *F04D 15/0254* (2013.01)

(58) Field of Classification Search
CPC .. F04D 15/0254; F04D 27/0292; F04B 49/02; F04B 49/103
See application file for complete search history.

(56) References Cited

U.S. PATENT DOCUMENTS

2008/0310967 A1 12/2008 Franz et al.
2012/0173859 A1* 7/2012 Wang ..... G06F 9/4401 713/2

(Continued)

FOREIGN PATENT DOCUMENTS

CN 101680457 A 3/2010
CN 103671046 A 3/2014

(Continued)

OTHER PUBLICATIONS

Clarke Mechanical Engine Controller Alarm Verification Procedure, MECAB Engine Controller Alarm Verification Procedure, C1365751 revB, May 31, 2019 (Year: 2019).*

(Continued)

*Primary Examiner* — Schyler S Sanks
(74) *Attorney, Agent, or Firm* — Michael Best & Friedrich LLP

(57) ABSTRACT

A method for operating a fluid conveying device (4), in particular a pump, a fan, a compressor or a valve, by way of a control unit (14), wherein the fluid conveying device with a deactivated emergency running mode is switched on at least in the case of initial application of an operating power of the fluid conveying device, a setpoint rotational speed specification or a setpoint actuating value specification is transmitted to the fluid conveying device, and the emergency miming mode of the fluid conveying device is activated when the setpoint rotational speed specification or the setpoint actuating value specification exceeds a triggering value or the fluid conveying device is operated for longer than an activation duration with an invalid rotational speed or an invalid actuating value. Furthermore, the invention relates to a pump arrangement, a control unit, a computer program, and a machine-readable storage medium.

20 Claims, 2 Drawing Sheets

(56) References Cited

U.S. PATENT DOCUMENTS

| | | | | |
|---|---|---|---|---|
| 2013/0093505 | A1* | 4/2013 | Gupta | G05F 1/575 327/540 |
| 2014/0271235 | A1* | 9/2014 | Magyar | F04B 49/103 318/494 |
| 2019/0368490 | A1 | 12/2019 | Maishigi et al. | |

FOREIGN PATENT DOCUMENTS

| | | | | |
|---|---|---|---|---|
| CN | 106207227 | A | 12/2016 | |
| CN | 107575401 | A | 1/2018 | |
| DE | 3617195 | A1 | 11/1987 | |
| DE | 4040847 | A1 | 7/1992 | |
| DE | 602004010185 | T5 | 11/2008 | |
| DE | 102016108118 | A1 | 7/2017 | |
| EP | 1364825 | A1 * | 11/2003 | H02P 6/28 |
| JP | 2013185500 | A | 9/2013 | |
| WO | 2008087153 | A1 | 7/2008 | |

OTHER PUBLICATIONS

EP1364825A1 Translation (Year: 2003).*
Translation of International Search Report for Application No. PCT/EP2020/085176 dated Feb. 24, 2021 (2 pages).

* cited by examiner

METHOD FOR OPERATING A PUMP

BACKGROUND OF THE INVENTION

The invention relates to a method for operating a fluid delivery device, in particular a pump, a compressor, a fan or a valve. Furthermore, the invention relates to a pump arrangement, a compressor arrangement, a fan arrangement, a valve arrangement, a control unit, a computer program and a machine-readable storage medium.

In different technical fields, for example in vehicles, cooling circuits are used to thermally regulate one or more components. Such cooling circuits are often supported by speed-regulated, electric auxiliary water pumps in addition to a main water pump or are used in the event of a failure of the main water pump.

The auxiliary water pump is controlled by a central control unit and supplied with voltage. If the auxiliary water pump is supplied with voltage, it sets the setpoint speed received from the central control unit. If the communication between the central control unit and the auxiliary water pump is interrupted, the auxiliary water pump is put into an emergency mode. In the emergency mode of the auxiliary water pump, a maximum speed is set to maintain a cooling function of the cooling circuit and to compensate a possible failure of the main water pump.

During the production and assembly of the cooling circuit, the auxiliary water pump may be supplied with voltage before the cooling circuit is filled with a coolant. This process takes place without communication with the central control unit, whereby the auxiliary water pump is put into the emergency mode. As a result of operating the dry auxiliary water pump at the maximum speed, the auxiliary water pump may become damaged and exhibit increased noise generation.

SUMMARY OF THE INVENTION

The object on which the invention is based can be regarded as proposing a method for operating a fluid delivery device, in particular a pump, a fan, a valve or a compressor, which prevents activation of the emergency mode during the assembly of the fluid delivery device.

According to an aspect of the invention, a method for operating a fluid delivery device is provided. The method can be carried out by a control unit or a control module which is integrated in the fluid delivery device. The control module in the fluid delivery device can communicate with a central control unit via a communications interface and thus receive and execute control instructions.

The fluid delivery device is preferably switched on with the emergency mode deactivated, at least when an operating power is applied to the fluid delivery device for the first time. The control module in the fluid delivery device can thus prevent the fluid delivery device from being brought to high speed, in particular if it is designed as a pump, compressor or fan, or it can prevent an adjustment of the fluid delivery device, in particular if it is designed as a valve, without an established communications connection with the central control unit. A first-time application of the operating power can be detected for example by the control module reading a storage device. Upon the first-time application of the operating voltage, the storage device can be empty or it can contain a note relating to the first-time operation.

In a further step, a setpoint speed selection or setpoint control-value selection is transmitted to the fluid delivery device. In this case, the setpoint speed selection or the setpoint control-value selection can be generated by the control module in the fluid delivery device or received by the central control unit and relayed to the fluid delivery device by the control module in the fluid delivery device.

The emergency mode of the fluid delivery device is subsequently activated if the setpoint speed selection or setpoint control-value selection exceeds a trigger value or the fluid delivery device is operated at an invalid setpoint speed, in particular with an invalid setpoint speed selection, or with an invalid setpoint control-value selection for longer than an activation time. As a result of this measure, the emergency mode of the fluid delivery device can only be activated if the fluid delivery device is operated at a sufficiently high setpoint speed, in particular with a sufficiently high setpoint speed selection, or with a sufficiently high setpoint control-value selection.

Alternatively or additionally, the emergency mode of the fluid delivery device can be activated if the fluid delivery device is operated at an invalid speed, in particular with an invalid setpoint speed selection, or with an invalid setpoint control-value selection, during a predefined activation time.

The emergency mode in particular induces the fluid delivery device to be operated at a maximum speed. The fluid delivery device is preferably actuated with maximum power. It is advantageous that, as a result of the actuation at maximum speed or with maximum power, possible obstructions and therefore contamination, for example, can be eliminated. Once the contamination is eliminated, the emergency mode is preferably terminated. In the case of a valve, the emergency mode can be used to clear obstructions. In particular, the valve can move back and forth multiple times, at least to a certain extent.

In this case, the speed of the fluid delivery device can be compared to the setpoint speed selection, wherein, taking into account tolerances, a deviation results in an invalid speed of the fluid delivery device. The activation time can be a defined time period during which temporary deviations between the speed of the fluid delivery device and the setpoint speed selection can be compensated.

Activating the emergency mode enables or permits the fluid delivery device to be put into emergency mode operation.

According to an exemplary embodiment, the fluid delivery device is designed as a pump. When installing or assembling the pump in the factory, the pump may be supplied with voltage before a cooling circuit is filled, without the central control unit already selecting a valid setpoint speed. As a result of the method and the control module, activation of the emergency mode of the pump and harmful dry-running of the pump can be prevented. In particular, the emergency mode of the pump can only be activated once a valid setpoint speed selection of the superordinate or central control unit is received.

According to a further exemplary embodiment, the fluid delivery device is designed as a fan. When installing or assembling the fan in the factory, the fan may be supplied with voltage without the central control unit already selecting a valid setpoint speed. As a result of the method and the control module, activation of the emergency mode of the pump and a harmful over-speed of the fan can be prevented. In particular, the emergency mode can only be activated after a valid setpoint speed selection of the superordinate or central control unit is received.

According to a further exemplary embodiment, the fluid delivery device is designed as a compressor. When installing or assembling the compressor in the factory, the compressor may be supplied with voltage before a fluid circuit, in particular a coolant circuit, is filled, without the central control unit already specifying a valid setpoint speed selection. As a result of the method and the control module, activation of the emergency mode of the compressor and harmful dry-running of the compressor can be prevented. In particular, the emergency mode of the compressor can only be activated once a valid setpoint speed selection of the superordinate or central control unit is received.

According to an exemplary embodiment, the fluid delivery device is designed as a valve. When installing or assembling the valve in the factory, the valve may be supplied with voltage without the central control unit already specifying a valid setpoint speed selection. As a result of the method and the control module, activation of the emergency mode of the valve can be prevented. In particular, the emergency mode of the valve can only be activated once a valid setpoint speed selection of the superordinate or central control unit is received.

The setpoint speed selection is preferably higher than a previously defined threshold. If the fluid delivery device is disconnected from the voltage supply, the emergency mode is deactivated again after the voltage is re-applied to the fluid delivery device. The deactivation of the emergency mode via the control module in the fluid delivery device therefore serves as a protective mechanism of the fluid delivery device to prevent inadvertent dry-running if it is designed as a pump or compressor, or an over-speed if it is designed as a fan, or an opening or closing of the valve at high speed.

The fluid delivery device can be for example a coolant pump or an auxiliary water pump. In particular, the fluid delivery device can be designed to deliver or regulate any liquid and is not restricted to use in the automotive field.

According to a further aspect of the invention, a control module is provided, wherein the control module is designed to execute the method. The control module can be a control module in the fluid delivery device, for example, which is integrated in the fluid delivery device.

For example, the control module can be combined with a fluid delivery device controller or coupled to the fluid delivery device controller.

The control module in the fluid delivery device can preferably be couplable to a central control unit via a communications connection in order to be able to receive and execute setpoint speed selections.

Moreover, according to an aspect of the invention, a computer program is provided, which comprises commands which, when the computer program is executed by a computer or a control unit, prompt this to execute the method according to the invention. According to a further aspect of the invention, a machine-readable storage medium is provided, on which the computer program according to the invention is stored.

According to an exemplary embodiment, an operating mode of the fluid delivery device during the operation of the fluid delivery device is stored in an internal storage device. The internal storage is preferably read upon activation of the fluid delivery device to set a recently used operating mode. The operating mode of the fluid delivery device can be in particular an activated or deactivated emergency mode. In the case of an activated emergency mode, the fluid delivery device can be put into emergency mode operation. In the case of a deactivated emergency mode, it is not possible to put the fluid delivery device into an emergency mode operation. The operating mode can moreover be configured in the form of an entry for initial operation of the fluid delivery device.

The internal storage can be integrated for example in the control module in the fluid delivery device or connectable to the control module in the fluid delivery device.

In particular, the recently used state of the emergency mode, activated emergency mode or deactivated emergency mode, can be stored in the internal storage and can therefore prevent inadvertent dry-running of the pump or the compressor, for example.

As a result of this measure, the emergency mode function of the fluid delivery device is ensured if, for example, a vehicle comprising the fluid delivery device has already left the factory and the fluid delivery device configured as a coolant pump has been previously activated with a filled cooled circuit.

According to a further exemplary embodiment, an emergency mode of the fluid delivery device is switched on if the setpoint speed, in particular the setpoint speed selection, of the fluid delivery device exceeds the trigger value. For example, the trigger value can be a defined speed level which can only be achieved via an active actuation of the central control unit.

Therefore, the emergency mode function of the fluid delivery device is not activated as a result of the fluid delivery device being inadvertently energized and reaching a negligible speed.

In a further advantageous configuration, the emergency mode of the fluid delivery device is initiated by the central control unit or by the control module in the fluid delivery device. In particular, the emergency mode of the fluid delivery device can be initiated only or exclusively by the central the central control unit or the control module in the fluid delivery device. As a result of this measure, the emergency mode can be specifically activated by a control command of the central control unit or the control module in the fluid delivery device.

According to a further exemplary embodiment, an emergency-mode speed, for example in the form of a rated speed or maximum speed, of the fluid delivery device is set when the emergency mode of the fluid delivery device is activated. If the fluid delivery device is put into emergency mode operation or the fluid delivery device puts itself into emergency mode operation, an unregulated delivery rate at a maximum speed or rated speed takes place in order to fulfill the intended delivery task without accounting for energy savings. It is thus ensured that an exemplary coolant pump adequately cools the components which are thermally coupled to the cooling circuit.

According to a further aspect of the invention, a pump arrangement is provided. The pump arrangement has at least one fluid delivery device designed a pump, and a control module connected to the pump to actuate and/or regulate the pump. The pump arrangement is designed to execute the method according to the invention.

According to a further aspect of the invention, a valve arrangement is provided. The valve arrangement has at least one fluid delivery device designed as a valve and a control module connected to the valve to actuate and/or regulate the valve. The valve arrangement is designed to execute the method according to the invention.

According to a further aspect of the invention, a compressor arrangement is provided. The compressor arrangement has at least one fluid delivery device designed a compressor and a control module connected to the compressor to actuate and/or regulate the compressor. The compressor is designed to execute the method according to the invention According to a further aspect of the invention, a fan arrangement is provided. The fan arrangement has at least one fluid delivery device designed as a fan and a control module connected to the fan to actuate and/or regulate the fan. The fan arrangement is designed to execute the method according to the invention.

Furthermore, the control unit in the fluid delivery device can be coupled to a central control unit via a communications connection in order to relay control commands or setpoint speed selections to the fluid delivery device.

The pump arrangement can be for example a coolant pump connected to a cooling circuit and having a control module and an optional central control unit.

The pump, the valve, the compressor can be in particular part of a coolant circuit, wherein they are responsible for the circulation of the coolant.

BRIEF DESCRIPTION OF THE DRAWINGS

Preferred exemplary embodiments of the invention are explained in more detail below with the aid of highly simplified schematic illustrations.

DETAILED DESCRIPTION

Figure 1:
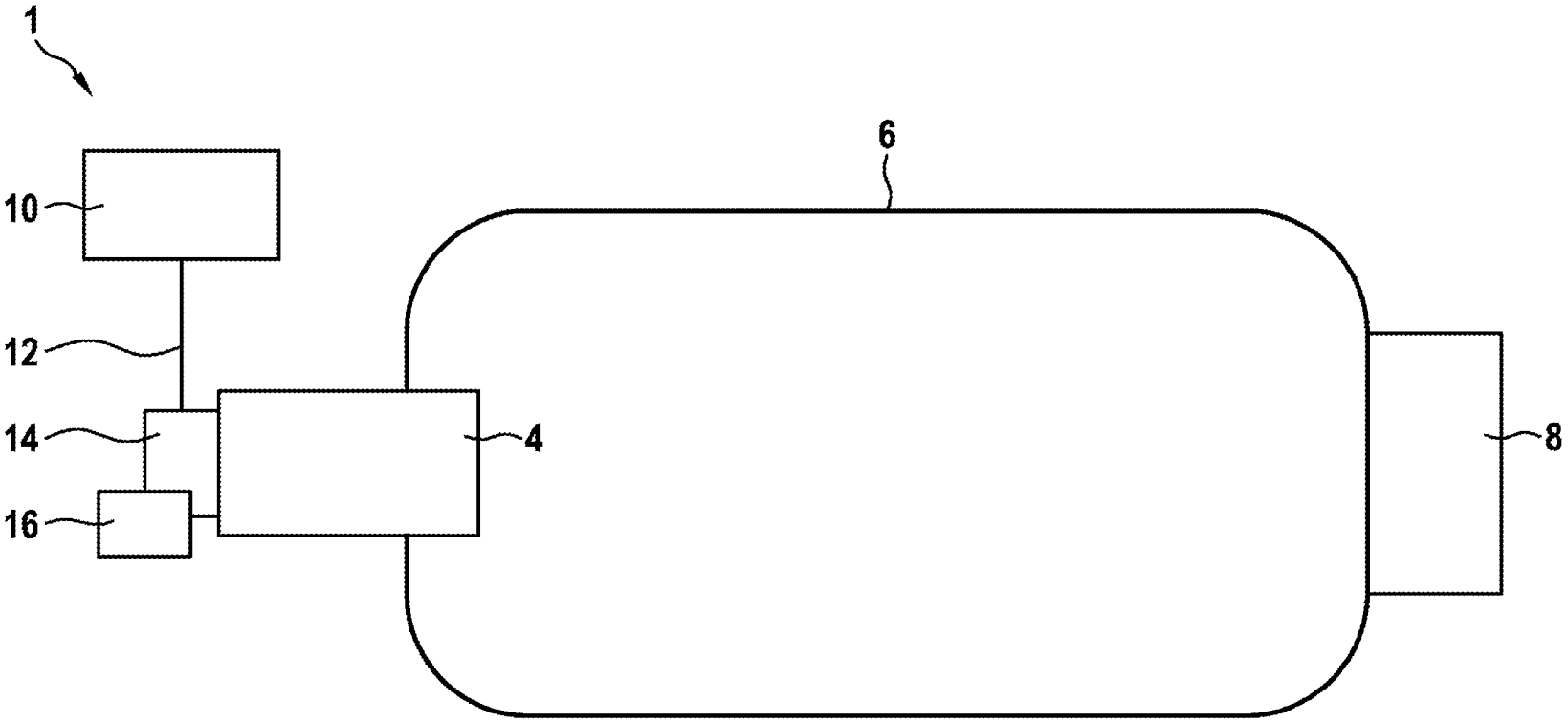
FIG. 1 shows a schematic illustration of a pump arrangement according to an embodiment and FIG. 2 shows a schematic flowchart for illustrating a method according to an embodiment.

FIG. 1 shows a schematic illustration of a fluid delivery arrangement 1 according to an embodiment. The fluid delivery arrangement 1 serves for executing a method 2 for operating a fluid delivery device 4.

The fluid delivery device 4 in the illustrated exemplary embodiment is configured as a cooling water pump or as an auxiliary water pump and is arranged in a cooling circuit 6.

The fluid delivery device 4 designed as a pump can therefore deliver a fluid, in particular coolant or refrigerant located in the fluid circuit 6, in particular coolant circuit or refrigerant circuit, and enable circulation of the fluid. The fluid circuit 6 is illustrated in simplified form, which means that, for example, radiators, connections, valves, heat exchangers and a plurality of components to be cooled are not illustrated.

By way of example, a component 8 to be cooled or heated is thermally coupled to the fluid circuit 6. The component 8 can be power electronics or an oil cooler, for example.

The fluid delivery arrangement, in particular the pump arrangement 1, valve arrangement, compressor arrangement, fan arrangement, has a central control unit 10, which is designed to transmit control commands to the fluid delivery device, in particular the pump 4. For example, the central control unit 10 can transmit setpoint speed selections to the fluid delivery device, in particular the pump 4. To this end, the central control unit 10 can transmit the control commands to a control module 14 in the fluid delivery device via a communications connection 12.

The control module 14 in the fluid delivery device can use the received control commands to actuate the fluid delivery device, in particular the pump 4, and therefore regulate the fluid delivery device, in particular the pump 4, according to a desired speed.

In addition to transmitting control commands, the communications connection 12 can also serve to supply the fluid delivery device 4 and the control module 14 in the fluid delivery device with operating power or electric energy.

The control module 14 in the fluid delivery device has a storage device 16. Recently used operating modes of the fluid delivery device 4 can be stored in the storage device 16.

In particular, an initial activation of the fluid delivery device 4 in an emergency mode operation can be prevented by the control module 14.

Furthermore, start-up can generally be prevented when the emergency mode is deactivated. Only once the emergency mode is activated is start-up also possible. Such general prevention of the start-up is particularly useful in fans, since these can have undesired consequences in the event of an unwanted start-up, in particular during assembly. In particular, it is possible to prevent the start-up when a fluid delivery device is switched on.

Figure 2:
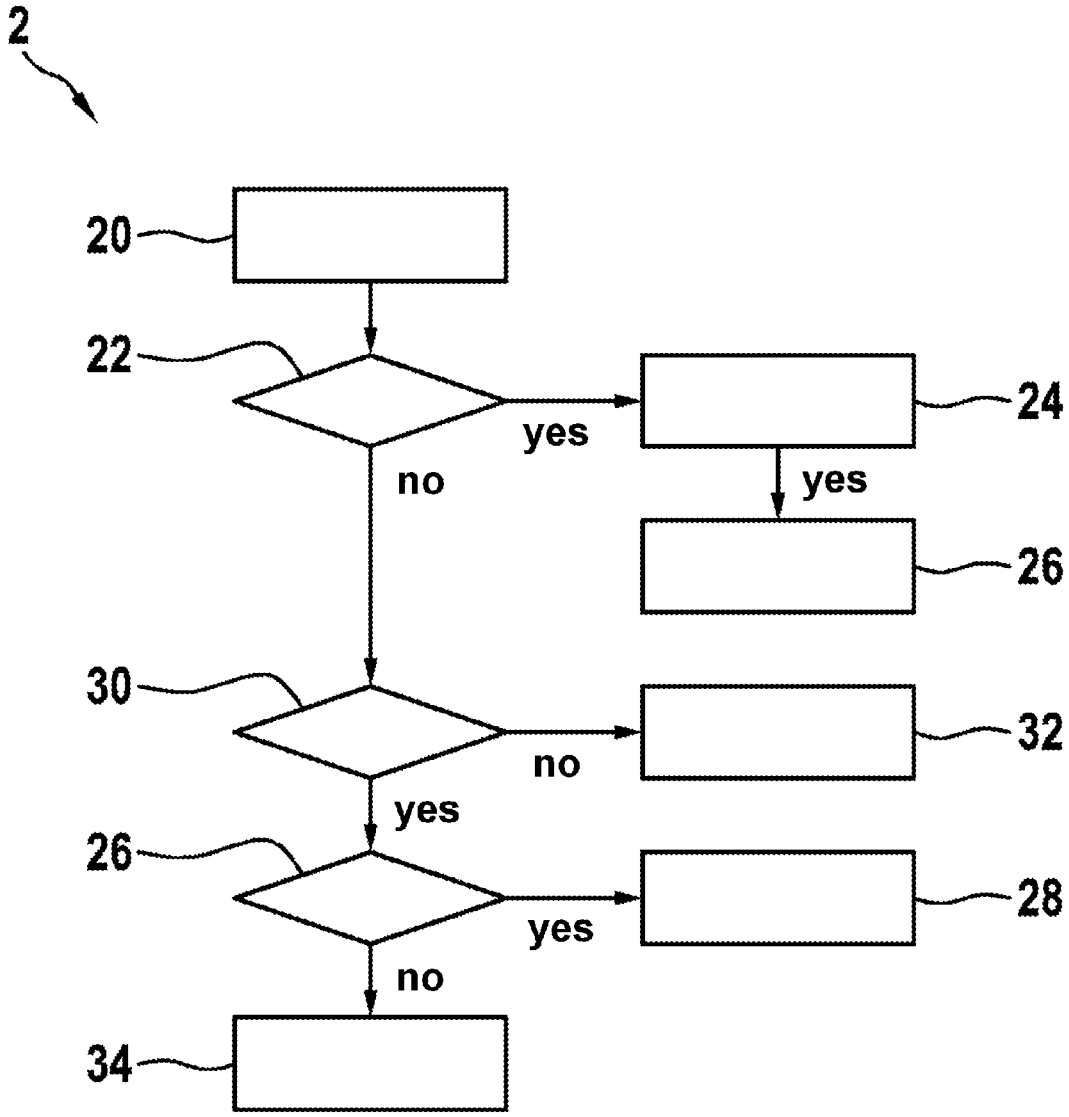

A schematic flowchart for illustrating a method 2 according to an embodiment is illustrated in FIG. 2. The method 2 serves for operating a fluid delivery device 4, in particular a pump, preferably an electronically speed-regulated auxiliary water pump, or in particular a valve, a fan, a compressor via the control module 14.

In a step 20, the fluid delivery device 4 is switched on with the emergency mode deactivated, at least when an operating power is applied to the fluid delivery device 4 for the first time.

In a further step 22, the control module 14 can check whether the fluid delivery device 4 is operated at a valid speed, which corresponds to a specified setpoint speed, in particular a setpoint speed selection.

If the fluid delivery device 4 is operated at a speed corresponding to the setpoint speed, in particular the setpoint speed selection, the set setpoint speed, in particular the setpoint speed selection, can be compared to a predefined activation threshold 24. If the setpoint speed, in particular the setpoint speed selection, of the fluid delivery device 4 exceeds the activation threshold, an emergency mode of the fluid delivery device 4 can be activated 26 by the control module 14. The same applies to the embodiment as a valve with regard to the setpoint control-value selection.

When the emergency mode of the fluid delivery device 4 is activated, the fluid delivery device 4 can be put into emergency mode operation 28 in an automated manner in the event of a broken communications connection 12. By activating the emergency mode, the fluid delivery device 4 has the option of being put into emergency mode operation.

If, upon the enquiry 22, a deviation between the speed and the setpoint speed selection is determined, the time or an activation time during which the fluid delivery device 4 is operated at an invalid speed or with an invalid control value can be measured 30.

"Invalid speed" is understood in particular to mean that the speed does not correspond to the setpoint speed selection. This can be due in particular to insufficient fluid being present in the fluid delivery device or the fluid delivery device being obstructed. It is also possible that the fluid delivery device is not properly connected and a receives a faulty signal. The actual speed can be detected in particular by means of a sensor or a method for determining the rotational position.

"Invalid control value" is understood in particular to mean that the control value does not correspond to the setpoint control-value selection. This can be the case in particular in the event of contamination, if the control path is blocked thereby.

If the activation time is not exceeded, the speed or the control value of the fluid delivery device 4 can be set 32 according to the setpoint speed selection or setpoint control-value selection.

If the activation time is exceeded, the fluid delivery device 4 is put into emergency mode operation 28 if the emergency mode has already been activated 26. If the emergency mode of the fluid delivery device 4 is not active, the fluid delivery device 4 is in particular deactivated 34 or the fluid delivery device continues to be operated without the emergency mode.

The emergency mode, in particular the emergency mode operation, is preferably alternatively and/or additionally switched on if it is activated when a setpoint speed selection or setpoint control-value selection value is present.

The activation time is in particular 1 to 15 seconds, preferably 3 to 10 seconds, for example 4 seconds.

Alternatively, start-up of the fluid delivery device is not possible when the emergency mode is deactivated.

"Fluids" are understood in particular to mean coolants or refrigerants and gases, in particular air.

The invention claimed is:

1. A method (2) for operating a fluid delivery device (4), via a control module (14), the method comprising:

deactivating an emergency mode by preventing the fluid conveying delivery device (4) from being transferred to an emergency mode operation, subsequently supplying a first-time application of an operating power to the fluid delivery device (4), establishing a communications connection (12) between the control module (14) and a central control unit (10), receiving a setpoint speed selection or setpoint control-value selection at the central control unit (10) and transmitting the same to the fluid delivery device (4), and activating the emergency mode of the fluid delivery device (4) when the setpoint speed selection or the setpoint control-value selection exceeds a trigger value or the fluid delivery device (4) is operated at an invalid speed or with an invalid control value for longer than an activation time, wherein the emergency mode operation comprises maintaining a cooling function for the fluid delivery device.

2. The method as claimed in claim 1, wherein an operating mode of the fluid delivery device (4) during the operation of the fluid delivery device (4) is stored in an internal storage device (16), wherein the internal storage device (16) is read upon activation of the fluid delivery device (4) to set a recently used operating mode of the fluid delivery device (4).

3. The method as claimed in claim 1, wherein the emergency mode of the fluid delivery device (4) is switched on if the setpoint speed selection or the setpoint control-value selection of the fluid delivery device (4) exceeds the trigger value.

4. The method as claimed in claim 3, wherein the emergency mode of the fluid delivery device (4) is initiated by the central control unit (10) or the control module (14).

5. The method as claimed in claim 4, wherein an emergency-mode speed is set when the emergency mode of the fluid delivery device (4) is activated.

6. A non-transitory, computer-readable medium containing instructions that when executed by a computer cause the computer to perform the method of claim 1.

7. A fluid delivery arrangement (1) comprising:

a fluid delivery device (4);

a central control unit (10) for transmitting commands to the fluid delivery device (4), the central control unit (10) configured to:

transmit operating power to the fluid delivery device (4), and receive a setpoint speed selection or setpoint control-value selection and transmit the same to the fluid delivery device (4); and a control module (14) communicatively connected to the central control unit (10) to receive the commands and actuate and/or regulate the fluid delivery device (4), wherein the control module is configured to:

supply a first-time operating power to the fluid delivery device (4) when an emergency mode is deactivated, establish a communications connection (12) between the control module (14) and the central control unit (10), and activate the emergency mode of the fluid delivery device (4) when the setpoint speed selection or the setpoint control-value selection exceeds a trigger value or the fluid delivery device (4) is operated at an invalid speed or with an invalid control value for longer than an activation time, wherein the emergency mode operation comprises maintaining a cooling function for the fluid delivery device.

8. The fluid delivery arrangement of claim 7, wherein the fluid delivery device is a pump.

9. The fluid delivery arrangement of claim 7, wherein the fluid delivery device is a valve.

10. The fluid delivery arrangement of claim 7, wherein the fluid delivery device is a compressor.

11. The fluid delivery arrangement of claim 7, wherein the fluid delivery device is a fan.

12. The fluid delivery arrangement of claim 7, further comprising an internal storage device (16) read upon activation of the fluid delivery device (4) to set a recently used operating mode of the fluid delivery device (4), wherein the recently used operating mode is a deactivated emergency mode or an activated emergency mode.

13. The fluid delivery arrangement of claim 12, wherein the control module is configured to activate a start-up of the fluid delivery device (4) when the emergency mode is activated.

14. The fluid delivery arrangement of claim 7, wherein the emergency mode is deactivated when the operating power is disconnected and re-applied to the fluid delivery device.

15. The method as claimed in claim 1, further comprising starting the fluid delivery device (4) when the emergency mode is activated.

16. The method as claimed in claim 2, wherein the recently used operating mode is a deactivated emergency mode or an activated emergency mode.

17. The method as claimed in claim 1, further comprising emptying an internal storage device (16) or providing a note relating to supplying the operating power for the first time in the storage device (16) after the first-time application of the operating power.

18. The method as claimed in claim 17, wherein deactivating the emergency mode comprises disconnecting the operating power and re-applying the operating power to the fluid delivery device.

19. The method as claimed in claim 1, wherein maintaining a cooling function for the fluid delivery device comprises operating at an unregulated delivery rate.

20. The method as claimed in claim 19, wherein the unregulated delivery rate includes one of a maximum speed or rated speed.

* * * * *